US009386906B2

(12) United States Patent
Brosnan et al.

(10) Patent No.: US 9,386,906 B2
(45) Date of Patent: Jul. 12, 2016

(54) PORT ASSEMBLY FOR USE WITH A CLEANING DEVICE AND METHOD FOR ASSEMBLING THE SAME

(75) Inventors: Daniel Vincent Brosnan, Louisville, KY (US); Daniel Patrick Ernst, Louisville, KY (US); Joshua Flesch, Louisville, KY (US); Om Hari, Louisville, KY (US); Amelia Lear Hensley, Crestwood, KY (US); Nicholas Okruch, Jr., Mt. Washington, KY (US)

(73) Assignee: General Electric Company, Schenectady, NY (US)

( * ) Notice: Subject to any disclaimer, the term of this patent is extended or adjusted under 35 U.S.C. 154(b) by 1093 days.

(21) Appl. No.: 12/957,315

(22) Filed: Dec. 15, 2010

(65) Prior Publication Data

US 2012/0152290 A1 Jun. 21, 2012

(51) Int. Cl.

| | |
|---|---|
| ***D06F 39/02*** | (2006.01) |
| ***A47L 15/44*** | (2006.01) |
| ***D06F 33/02*** | (2006.01) |
| *A47L 15/00* | (2006.01) |

(52) U.S. Cl.

CPC ..... *A47L 15/4418* (2013.01); *A47L 15/449* (2013.01); *D06F 33/02* (2013.01); *D06F 39/022* (2013.01); *A47L 15/0049* (2013.01); *A47L 2301/08* (2013.01); *A47L 2401/023* (2013.01); *A47L 2401/026* (2013.01); *A47L 2501/07* (2013.01); *D06F 2202/02* (2013.01); *D06F 2204/02* (2013.01); *Y10T 29/49826* (2015.01)

(58) Field of Classification Search

CPC ... D06F 39/022; D06F 39/024; D06F 39/028; A47L 15/4418; A47L 15/4463; A47L 15/44; A47L 15/4445; A47L 15/449

USPC ..... 68/17 R, 12.18, 207; 134/99.2, 117; 222/325, 52, 129, 132, 651

See application file for complete search history.

(56) References Cited

U.S. PATENT DOCUMENTS

| | | | | |
|---|---|---|---|---|
| 5,014,211 | A * | 5/1991 | Turner et al. | 700/239 |
| 5,839,454 | A | 11/1998 | Matz | |
| 5,909,825 | A * | 6/1999 | Lydford | 222/67 |
| 5,988,456 | A * | 11/1999 | Laible | 222/464.1 |
| 2002/0026828 | A1* | 3/2002 | Fehrenbach et al. | 73/290 V |
| 2002/0050209 | A1* | 5/2002 | D'Antonio et al. | 99/280 |
| 2003/0106907 | A1* | 6/2003 | Harrison et al. | 222/383.1 |
| 2007/0044819 | A1* | 3/2007 | Chan et al. | 134/18 |
| 2008/0110479 | A1* | 5/2008 | Veening et al. | 134/113 |
| 2008/0229790 | A1* | 9/2008 | Kim et al. | 68/17 R |
| 2010/0071777 | A1* | 3/2010 | Smith et al. | 137/14 |

FOREIGN PATENT DOCUMENTS

| | | | | |
|---|---|---|---|---|
| IT | EP 1884584 A2 * | 2/2008 | | D06F 39/022 |
| WO | WO 2009033016 A2 * | 3/2009 | | D06F 33/02 |

* cited by examiner

*Primary Examiner* — Joseph L Perrin
*Assistant Examiner* — Irina Graf
(74) *Attorney, Agent, or Firm* — Dority & Manning, P.A.

(57) ABSTRACT

A port assembly for use with a refillable storage container of a cleaning device includes a cap assembly having a sensor aperture and an outlet aperture. The cap assembly is configured to couple to a lip of the storage container. A sensor assembly extends through the sensor aperture and is coupled to the cap assembly, and an outlet assembly extends through the outlet aperture and is coupled to the cap assembly. The outlet assembly is coupled in fluid communication with a cleaning cavity of the cleaning device and the storage container.

12 Claims, 5 Drawing Sheets

PORT ASSEMBLY FOR USE WITH A CLEANING DEVICE AND METHOD FOR ASSEMBLING THE SAME

BACKGROUND OF THE INVENTION

The embodiments described herein relate generally to a cleaning device and, more particularly to a port assembly for use with bulk storage containers in a cleaning device.

At least one known cleaning device is a clothes washing machine that enables detergent, softener, and/or bleach dispensing from bulk storage containers. More specifically, the washing machine includes a-refillable bulk storage container for each type of fluid being dispensed into a tub of the washing machine. In such a washing machine, each bulk storage container includes three separate interface ports each associated with a separate opening in the container—an inlet opening, an outlet opening, and a sensor opening. The inlet opening is sealed by a cap, the outlet opening is in flow communication with the tub, and a sensor within the sensor opening is communicatively coupled to a controller.

When a user desires to clean one of the bulk storage containers, for example, when changing types of detergent and/or types of fluid, the user may remove the bulk storage container from the washing machine. To do so, the outlet and the sensor are disconnected from the container. Once the container has been cleaned and/or maintained, the container is repositioned in the washing machine and the outlet and sensor are re-attached. Proper re-attachment of the outlet and/or sensor can be difficult, and improper re-attachment of the outlet and/or sensor can prevent the washing machine from being activated. When the washing machine will not activate, the user may place a service call, which is time-consuming and inconvenient. Even if the washing machine activates, the washing machine may not function properly because of the improper outlet and/or sensor attachment.

BRIEF SUMMARY OF THE INVENTION

In one aspect, a port assembly for use with a refillable storage container of a cleaning device is provided. The port assembly includes a cap assembly having a sensor aperture and an outlet aperture. The cap assembly is configured to couple to a lip of the storage container. A sensor assembly extends through the sensor aperture and is coupled to the cap assembly, and an outlet assembly extends through the outlet aperture and is coupled to the cap assembly. The outlet assembly is coupled in fluid communication with a cleaning cavity of the cleaning device and the storage container.

In another aspect, a cleaning device is provided. The cleaning device includes a cleaning cavity configured to receive items to be cleaned, at least one storage container configured to receive a fluid, and a port assembly coupled to the at least one storage container. The port assembly includes a cap assembly having a sensor aperture and an outlet aperture. The cap assembly is configured to couple to a lip of the storage container. A sensor assembly extends through the sensor aperture and is coupled to the cap assembly, and an outlet assembly extends through the outlet aperture and is coupled to the cap assembly. The outlet assembly is coupled in fluid communication with the cleaning cavity and the at least one storage container.

In yet another aspect, a method for assembling a cleaning device including a storage container having a cap assembly configured to couple to a lip of the storage container is provided. A sensor aperture and an outlet aperture are defined through the cap assembly. The method includes coupling a sensor assembly to the cap assembly such that the sensor assembly extends through the sensor aperture, and coupling an outlet assembly to the cap assembly such that the outlet assembly extends through the outlet aperture. The outlet assembly is configured to channel the fluid from the storage container to a cleaning cavity of the cleaning device. The cap assembly, the sensor assembly, and the outlet assembly form an integrated port assembly.

BRIEF DESCRIPTION OF THE DRAWINGS

FIG. 1 is a schematic view of a cleaning device.

FIG. 2 is a perspective view of a storage container that may be used with the cleaning device shown in FIG. 1.

FIG. 3 is a side perspective view of a port assembly that may be used with the storage containers shown in FIGS. 1 and 2.

FIG. 4 is a partially cut-away perspective view of the port assembly shown in FIG. 3.

FIG. 5 is a flowchart of an exemplary method for assembling the cleaning device shown in FIGS. 1-4.

DETAILED DESCRIPTION OF THE INVENTION

The embodiments described herein provide an integrated port assembly for use with a bulk storage container within a cleaning device, such as a washing machine. The port assembly integrates a cap, a sensor, and an outlet into one piece. As such, the cap, the sensor, and the outlet form one component that can easily be removed and/or attached to the storage container. A user of a cleaning device that includes an embodiment of the port assembly described herein interfaces with the one port assembly rather than three different ports of the storage container, as are included with conventional storage containers. Embodiments of the port assembly described herein can be keyed to assure alignment and fixed position for ease of reinstallation of the port assembly.

Figure 1:
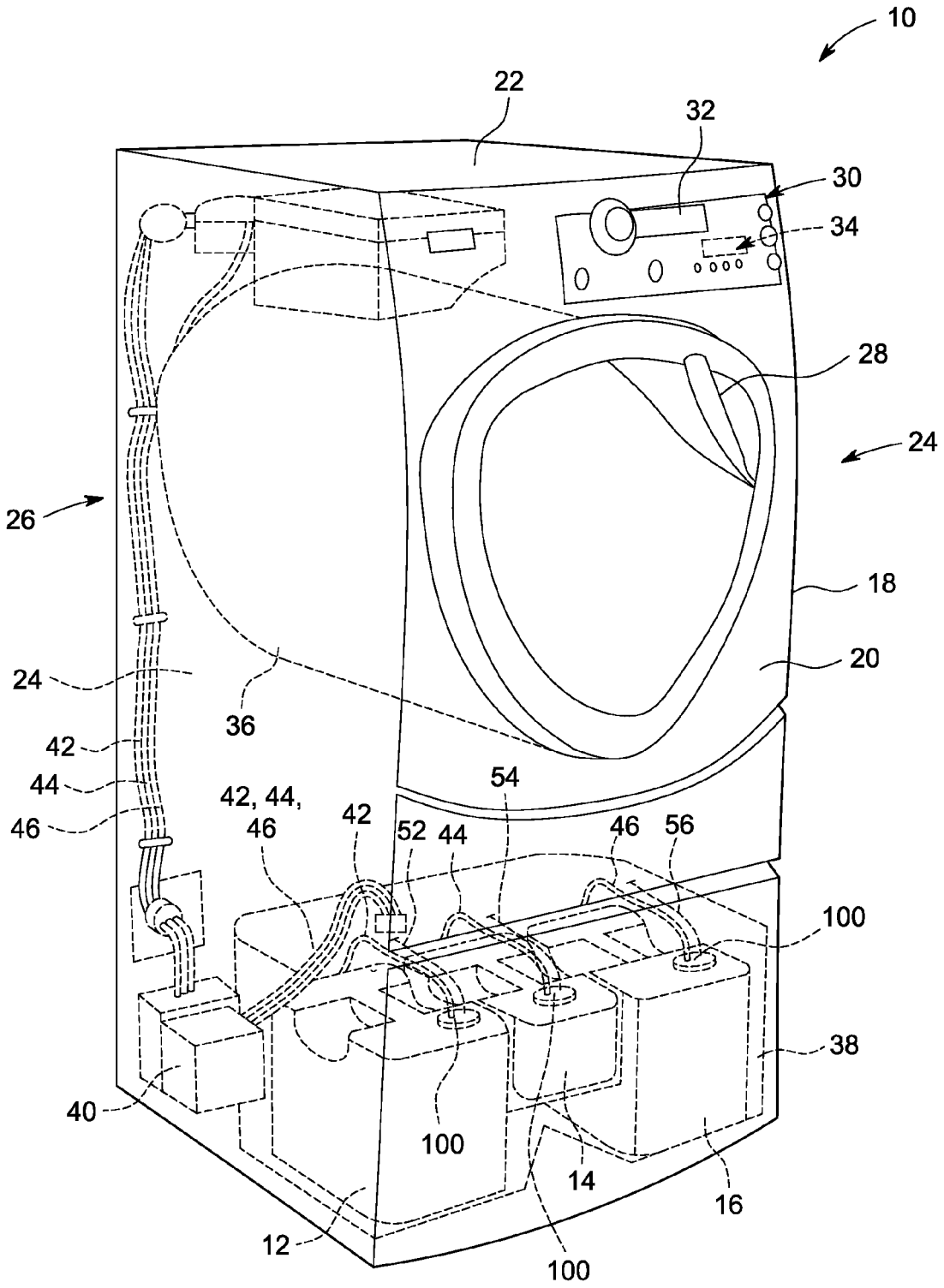
FIGS. 1-5 show exemplary embodiments of the systems and method described herein.
Figure 2:
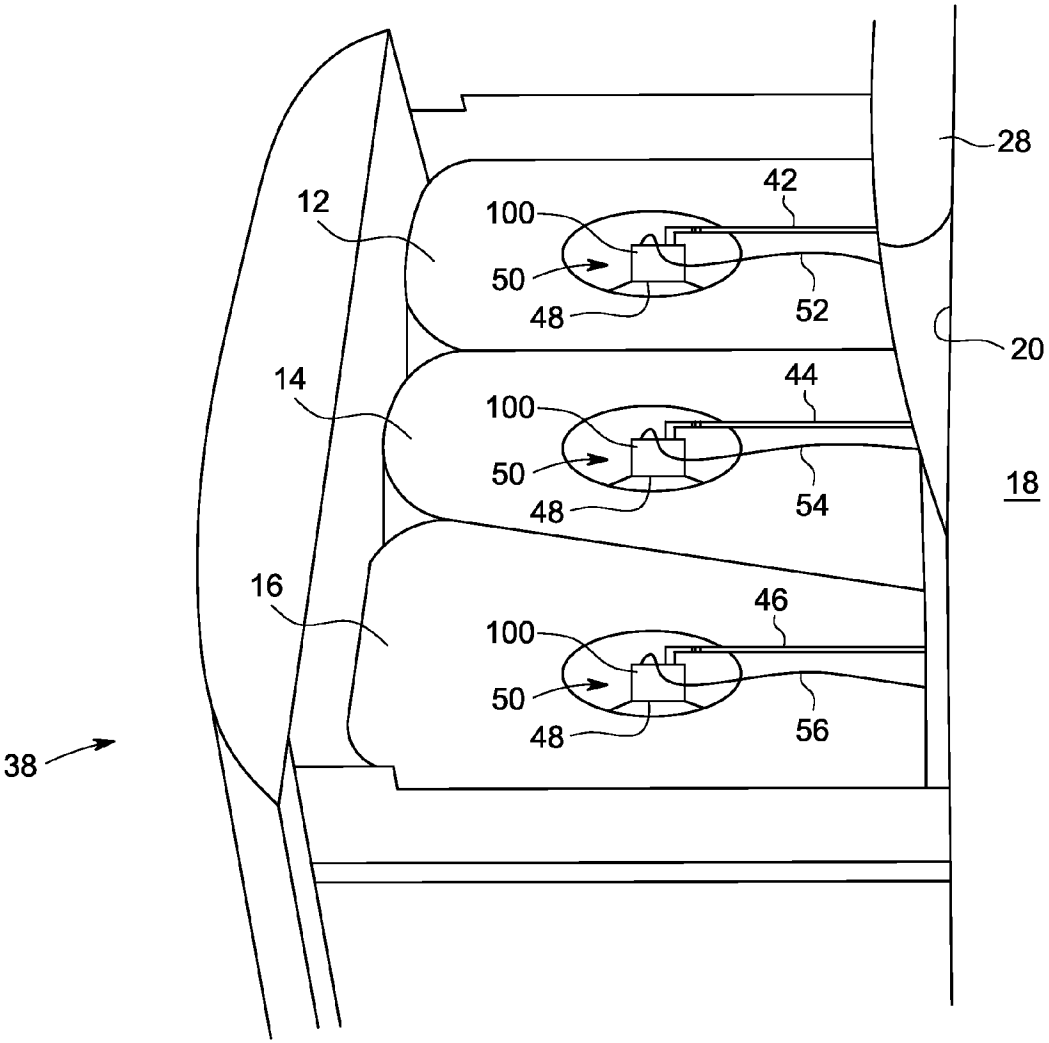

FIG. 1 is a perspective see-through view of an exemplary cleaning device 10, which in one embodiment is a washing machine. FIG. 2 is a perspective view of storage containers 12, 14, and 16 that may be used with cleaning device 10. As illustrated in FIG. 1, cleaning device 10 is a horizontal axis laundry washing machine. However, the embodiments described herein can also be used with other forms of laundry treatment machines as well, such as vertical axis laundry cleaning devices. It is also contemplated that the benefits of the embodiments described herein accrue to other forms of cleaning devices, such as for example, laundry washing machines, dry cleaning machines, washer/dry cleaning combination machines, and dishwashing machines. Further, the cleaning device 10 can include more or less than three containers 12, 14, and/or 16. Therefore, cleaning device 10 is provided by way of illustration rather than limitation. Accordingly, the following description is for illustrative purposes only, and there is no intention to limit application of the present invention to any particular cleaning device 10.

In the exemplary embodiment, in which cleaning device 10 is a washing machine, cleaning device 10 includes a cabinet 18 having a front panel 20, a top panel 22, side panels 24, and a back panel 26. A door 28 is mounted to front panel 20 and is rotatable about a hinge (not shown) between an open position (not shown) facilitating access to a basket (not shown) in an interior of cleaning device 10 that holds a laundry load and a closed position (as shown in FIG. 1) forming a substantially sealed enclosure over the basket. A control panel 30, including a plurality of input selectors, is coupled to front panel 20. Control panel 30 and the input selectors collectively form a user interface for operator selection of machine cycles and features and, in one embodiment, a display section 32 indicates selected features, machine status, and other items of interest to users. Control panel 30 is communicatively coupled to a controller 34 of cleaning device 10. Controller 34 is configured to perform the processes and/or methods described herein and/or any other suitable processes and/or methods that enable cleaning device 10 to function as described herein. Further, as used herein, "communicative coupling," or variations thereof, refers to a link, such as a conductor, a wire, and/or a data link, between two or more components of cleaning device 10 that enables signals, electric currents, and/or commands to be communicated between the two or more components. The link is configured to enable one component to control an operation of another component of cleaning device 10 using the communicated signals, electric currents, voltages, and/or commands.

In the exemplary embodiment, cleaning device 10 includes a tub 36 in which the basket is rotatably mounted. Tub 36 defines a cleaning cavity of cleaning device 10. It should be understood that cleaning device 10 can include any suitable cleaning cavity, and is not limited to tub 36. In the exemplary embodiment, at least one storage container 12, 14, and/or 16 is positioned in a chamber or drawer 38 beneath tub 36 and/or at any suitable location within cabinet 18. In the exemplary embodiment, storage containers 12, 14, and/or 16 are within a footprint of cabinet 18. At least one pump 40 is, located beneath tub 36 and/or within cabinet 18 to deliver fluid from storage containers 12, 14, and/or 16 to various components of cleaning device 10, including tub 36. Fluid lines 42, 44, and 46 extend from storage containers 12, 14, and 16 to pump 40 and/or from pump 40 to tub 36. In the exemplary embodiment, cleaning device 10 includes three storage containers 12, 14, and 16, one pump 40, and three fluid lines 42, 44, and 46. Each fluid line 42, 44, and 46 is coupled to a respective storage container 12, 14, and 16. Alternatively, more or less than one fluid line per storage container can be used. In a particular embodiment, a first storage container 12 contains detergent, a second storage container 14 contains fabric softener, and a third storage container 16 contains bleach.

Referring to FIG. 2, which shows drawer 38 in an open position, each storage container 12, 14, and 16 in drawer 38 includes a port assembly 100 coupled to a lip 48 that defines an opening 50 in each storage container 12, 14, and 16. Port assembly 100 is a multi-functional assembly that provides a cap assembly 102 (shown in FIGS. 3 and 4) for sealing opening 50, a sensor assembly 104 (shown in FIGS. 3 and 4) communicatively coupled to controller 34, and an outlet assembly 106 (shown in FIGS. 3 and 4) coupled in flow communication with tub 36. More specifically, communication links 52, 54, and 56 communicatively couple each port assembly 100 to controller 34, and fluid lines 42, 44, and 46 provide flow communication between each storage container 12, 14, and 16, respectively, and tub 36. Lip 48 of each storage container 12, 14, and 16 is threaded, or otherwise configured, for coupling to port assembly 100, as described in more detail below.

Operation of cleaning device 10 is controlled by controller 34 operatively coupled to control panel 30. A user of cleaning device 10 uses control panel 30 to select cycles and/or features of cleaning device 10. In response to user manipulation of control panel 30, controller 34 operates the various components of cleaning device 10 to execute selected machine cycles and features. In the exemplary embodiment, controller 34 receives data from at least one sensor 142 (shown in FIGS. 3 and 4) within each storage container 12, 14, and/or 16 to determine measurements and/or characteristics of a fluid in storage container 12, 14, and/or 16, as described in more detail below.

Figure 3:
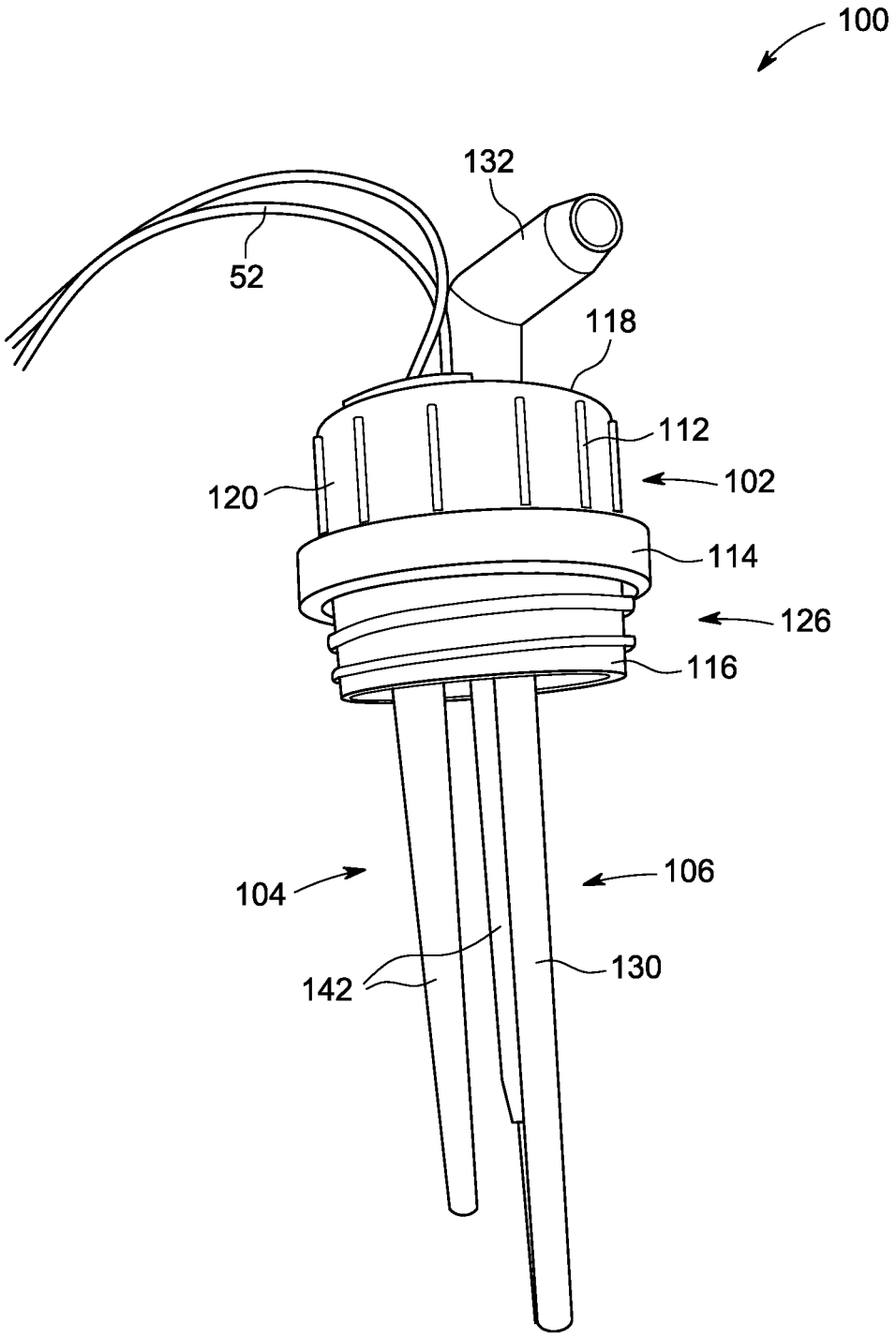
Figure 4:
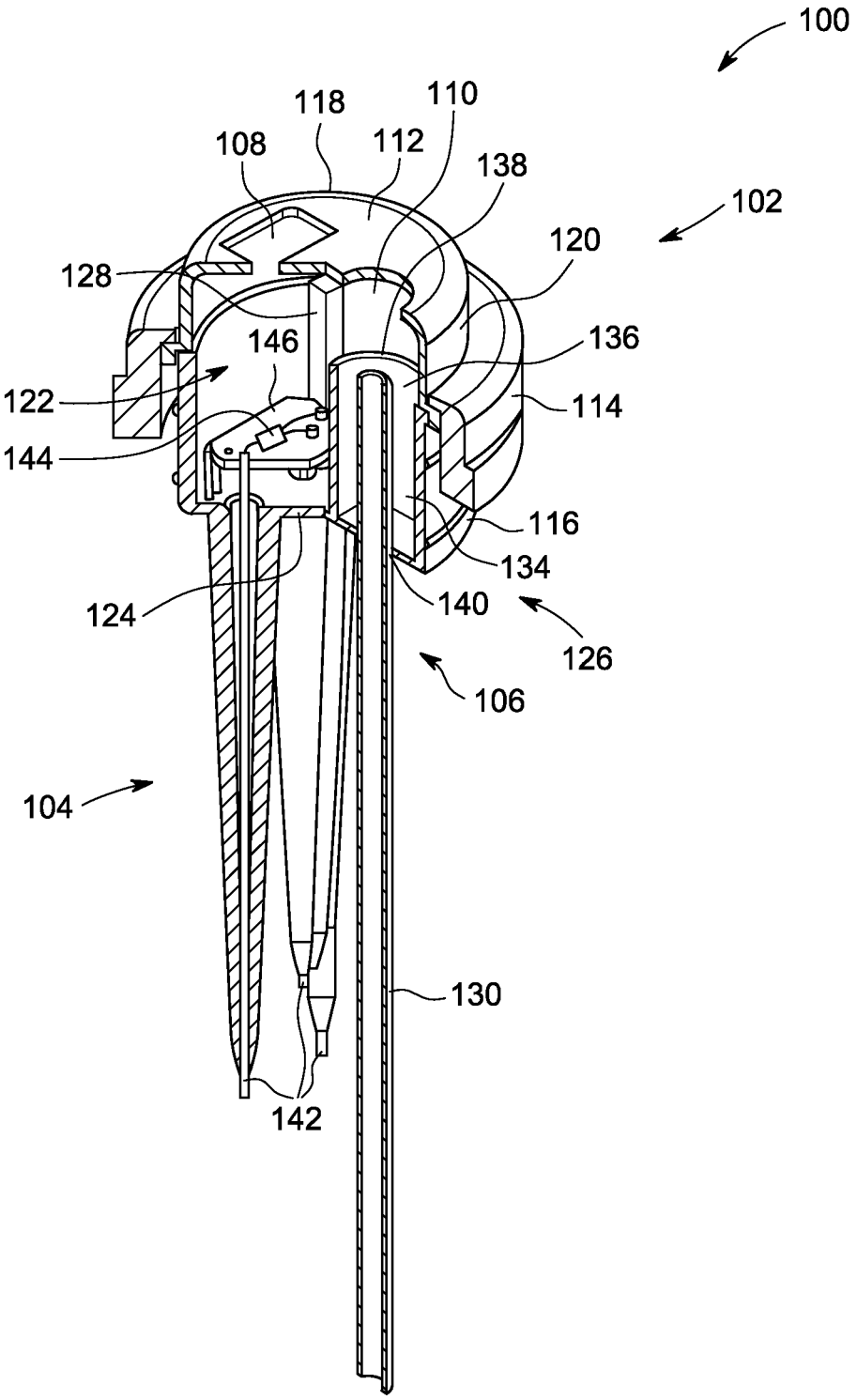

FIG. 3 is a side perspective view of port assembly 100, and FIG. 4 is a partially cut-away perspective view of port assembly 100. For simplicity, only one container 12 is described below; however, it should be understood that port assembly 100 as described below can be used with containers 14 and/or 16. In the exemplary embodiment, port assembly 100 includes a cap assembly 102, a sensor assembly 104, and an outlet assembly 106. Sensor assembly 104 and outlet assembly 106 are integrated into cap assembly 102. More specifically, a sensor aperture 108 and an outlet aperture 110 are defined through cap assembly 102, and sensor assembly 104 and outlet assembly 106 extend through, and/or are coupled to cap assembly 102 at, apertures 108 and 110, respectively. More specifically, cap assembly 102 includes a cap 112, a shoulder 114, and a coupling portion 116. At least a top wall 118 and a side wall 120 of cap 112 define a chamber 122 of port assembly IOU. A bottom wall 124 (FIG. 4) provides a substantially fluid-tight seal between chamber 122 and an interior space of container 12. As such, bottom wall 124 facilitates preventing the fluid within container 12 from entering chamber 122. In the exemplary embodiment, sensor aperture 108 and outlet aperture 110 are defined in top wall 118 of cap 112. In an alternative embodiment, sensor aperture 108 and/or outlet aperture 110 are defined at any suitable location of port assembly 100 that enables port assembly 100 to function as described herein.

In the exemplary embodiment, coupling portion 116 includes a coupling mechanism that interlocks with the coupling mechanism of lip 48 (shown in FIG. 2), such as threading, a snap-lock, twist-and-lock, pressure fit, quarter turn, and/or any other suitable coupling mechanism. In an alternative embodiment, shoulder 114 includes a coupling mechanism that interlocks with the coupling mechanism of lip 48. Shoulder 114 is also configured to facilitate coupling cap assembly 102 to container 12 and/or preventing cap assembly 102 from inadvertently being removed from container 12. In the exemplary embodiment, shoulder 114 and coupling portion 116 are formed integrally as one piece to form a cap connector 126. Alternatively, shoulder 114 and coupling portion 116 are coupled together to form cap connector 126. In the exemplary embodiment, cap connector 126 is rotatable coupled to cap 112. As such, cap 112 remains substantially stationary with respect to storage container 12 and cap connector 126 rotates with respect to cap 112 and storage container 12 when port assembly 100 is being coupled to storage container 12. Alternatively, cap 112, shoulder 114, and coupling portion 116 are formed integrally as one piece, and cap 112, shoulder 114, and coupling portion 116 rotate together with respect storage container 12 when port assembly 100 is being coupled to storage container 12. In an alternative embodiment, cap 112, shoulder 114, and coupling portion 116 are coupled together, and cap 112, shoulder 114, and coupling portion 116 rotate together with respect storage container 12 when port assembly 100 is being coupled to storage container 12.

In the exemplary embodiment, cap assembly 102 includes a key 128 extending from a surface of cap 112, shoulder 114, and/or coupling portion 116. Key 128 is configured to interlock with a locking mechanism (not shown), such as a groove, slot, and/or channel, defined within lip 48. Key 128 enables a user to properly align port assembly 100 with lip 48 such that sensor assembly 104 and outlet assembly 106 function properly. Further, key 128 inhibits rotation of cap assembly 102 with respect to lip 48 such that communication link 52 (FIG. 2) and/or fluid line 42 (FIG. 2) does not become bent, kinked, and/or otherwise improperly aligned during coupling of port assembly 100 to container 12.

Alternatively, cap assembly 102 does not include key 128. In the exemplary embodiment, a vent opening (not shown) can be defined through cap 112, and/or coupling portion 116 is configured to allow venting of storage container 12. Alternatively, or additionally, the vent opening is defined through container 12. In addition, once port assembly 100 is assembled, as described below, sensor aperture 108 and/or outlet aperture 110 is sealed to prevent debris, fluid, and/or other objects from entering chamber 122. Alternatively, sensor aperture 108 and/or outlet aperture 110 is not sealed.

Referring again to FIGS. 3 and 4, outlet assembly 106 includes an outlet tube 130 and an outlet connector 132. In the exemplary embodiment, cap assembly 102 includes a tube support 134 to which outlet tube 130 and/or outlet connector 132 is coupled. Tube support 134 is integrally formed with, or is coupled to, cap assembly 102. In the exemplary embodiment, tube support 134 extends into chamber 122 from bottom wall 124, side wall 120, and/or coupling portion 116 and includes an inner surface 136 and an outer surface 138. Additionally, or alternatively, tube support 134 extends downward from bottom wall 124. In the exemplary embodiments inner surface 136 defines an aperture 140 in bottom wall 124. Outlet tube 130 is substantially rigid and removably coupled to tube support 134 and outlet connector 132. Alternatively, outlet tube 130 is not removably coupled to tube support 134 and/or outlet connector 132, such as being integrally formed as one piece with tube support 134 and/or outlet connector 132. In an alternative embodiment, outlet tube 130 is at least partially flexible.

Outlet tube 130 and outlet connector 132 are coupled to cap assembly 102 at tube support 134. More specifically, outlet tube 130 is inserted into a bottom end of tube support 134 and is surrounded by inner surface 136, and outlet connector 132 is inserted into outlet aperture 110 and tube support 134 and coupled about an outer surface of outlet tube 130. Alternatively, outlet tube 130 and/or outlet connector 132 is positioned about outer surface 138 of tube support 134, and/or outlet connector 132 is positioned within an inner surface of outlet tube 130. In the exemplary embodiment, outlet assembly 106 is positioned adjacent sensor assembly 104 to provide support to at least a portion of sensor assembly 104.

In a particular embodiment, outlet tube 130 and/or outlet connector 132 is removable from cap assembly 102 at tube support 134 for cleaning and/or maintenance. Alternatively, outlet tube 130 and/or outlet connector 132 is formed integrally with tube support 134. In an alternative embodiment, outlet tube 130 is coupled directly to, or is formed integrally with, outlet connector 132 and coupled to cap assembly 102. In the exemplary embodiment, outlet connector 132 and/or outlet tube 130 extends from an interior of storage container 12, through cap assembly 102 at tube support 134, and from top wall 118 of cap 112. Outlet tube 130 is configured to draw a fluid from storage container 12 for dispensing into tub 36 (shown in FIG. 1). Outlet connector 132 is configured to couple outlet tube 130 and fluid line 42 (shown in FIGS. 1 and 2) in flow communication. Although outlet connector 132 is shown as an elbow connector in FIG. 3, outlet connector 132 can have any suitable size and/or shape that enables port assembly 100 to function as described herein.

As shown in FIG. 4, sensor assembly 104 includes at least one sensor 142 and a circuit board 144. Sensor assembly 104 is configured to detect and/or measure a property, such as a level, a chemical characteristic, and/or any other suitable measurement and/or characteristic, of a fluid within storage container 12. In the exemplary embodiment, at least a portion of sensor assembly 104 is configured to extend into container 12 when port assembly 100 is coupled to container 12. More specifically, at least a portion of sensor 142 extends downward from bottom wall 124. Further, at least a portion of sensor 142, such as a sensor housing, can be formed integrally with or coupled to cap assembly 102. As shown in FIGS. 3 and 4, sensor 142 is a conductivity sensor that detects and/or measures a level of fluid within storage container 12. Additionally, or alternatively, sensor 142 includes a pH level sensor, a color sensor, a viscosity sensor, a turbidity sensor, a chemical property sensor, a temperature sensor, a humidity sensor, a luminescence sensor, a bio-sensor, and/or any other suitable sensor that enables port assembly 100 to function as described herein.

Thus, in an one embodiment, sensor 142 is communicatively coupled to circuit board 144, which is communicatively coupled to controller 34 (shown in FIG. 1) via communication link 52. Sensor 142 and circuit board 144 are coupled within cap assembly 102 using a support 146. More specifically, sensor 142 and circuit board 144 are coupled to support 146, and support 146 is coupled to cap assembly 102. Support 146 is formed integrally as one piece with cap assembly 102 and/or is coupled to cap assembly 102. In the exemplary embodiment, support 146 and circuit board 144 are positioned within chamber 122 and isolated from the fluid within container 12 by bottom wall 124. In the exemplary embodiment, chamber 122 includes a material, such as plastic, that couples components within chamber 122 and/or defines components within chamber 122. Alternatively, chamber 122 is filled with a gas, such as air, at any suitable pressure, including pressures above and below atmospheric pressure.

Figure 5:
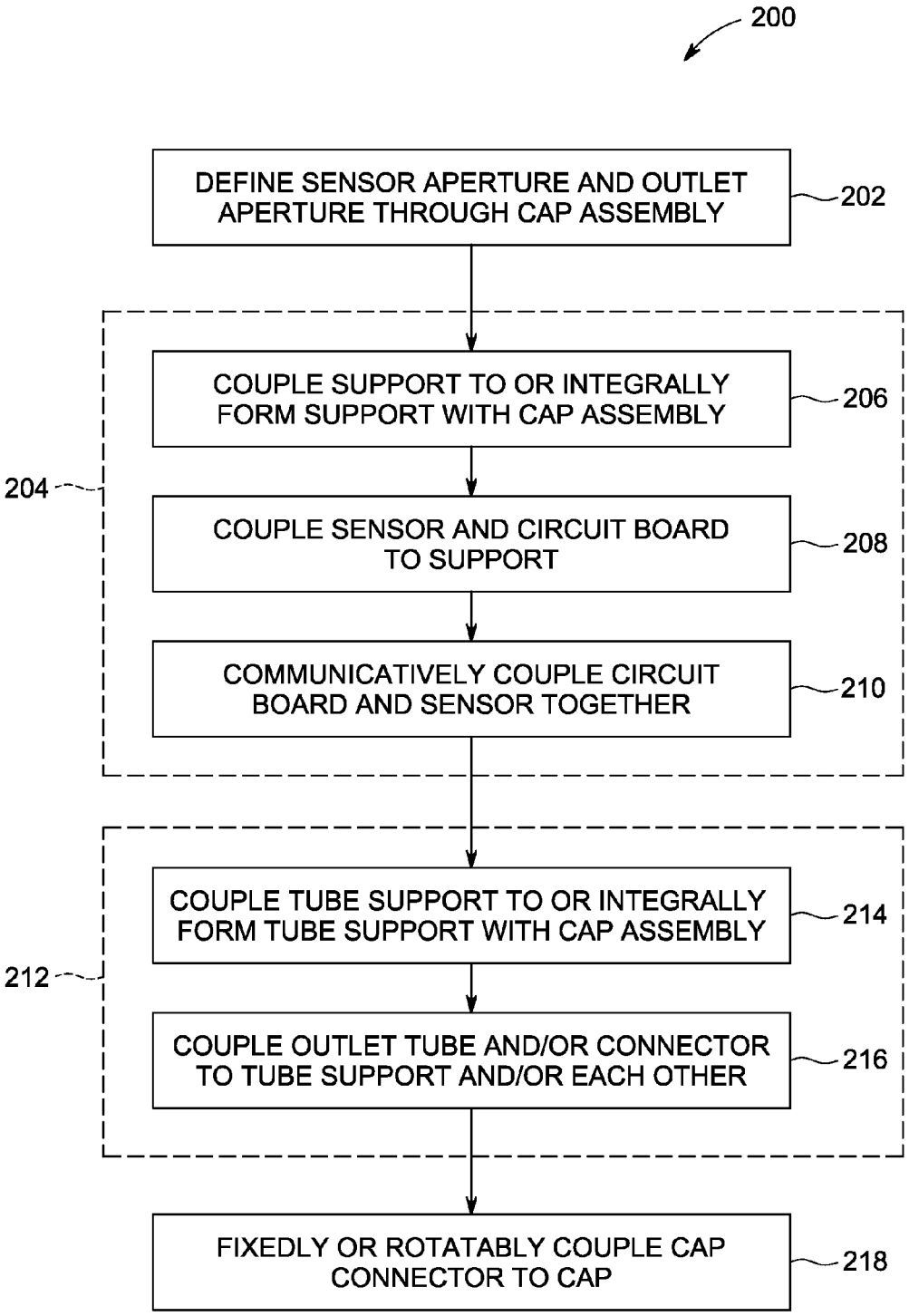

FIG. 5 is a flowchart of an exemplary method 200 for assembling the cleaning device shown in FIGS. 1-4. Referring to FIGS. 3-5, to make and/or manufacture port assembly 100, sensor aperture 108 and outlet aperture 110 are defined 202 through cap assembly 102. Sensor assembly 104 extends through sensor aperture 108 and is coupled 204 to cap assembly 102. More specifically, in the exemplary embodiment, support 146 is coupled to or integrally formed with 206 cap assembly 102, and sensor 142 and circuit board 144 are coupled 208 to support 146. Circuit board 144 and sensor 142 are communicatively coupled 210 together. Communication link 52 extends from circuit board 144 through sensor aperture 108 to controller 34. Outlet assembly 106 extends through outlet aperture 110 and is coupled 212 to cap assembly 102. More specifically, tube support 134 is coupled to or integrally formed with 214 cap assembly 102, and outlet tube 130 and/or outlet connector 132 are coupled 216 to tube support 134 and/or each other. Alternatively, outlet tube 130 is coupled directly to outlet connector 132. To form cap assembly 102, cap connector 126 is fixedly or rotatably coupled 218 to cap 112. Cap assembly 102, sensor assembly 104, and outlet assembly 106 form integrated port assembly 100.

Referring to FIGS. 1-4, to operate cleaning device 10, the user fills at least one storage container 12, 14, and/or 16 with a fluid, such as a detergent, a fabric softener, or bleach, via opening 50. For simplicity, only container 12 is described below; however it should be understood that the description also applies to containers 14 and/or 16. In the exemplary embodiment, the user then couples port assembly 100 to storage container 12. In the exemplary embodiment, sensor assembly 104 remains coupled to communication link 52 and outlet assembly 106 remains coupled to fluid line 42 during coupling of port assembly 100 to storage container 12. In an alternative embodiment, sensor assembly 104 is uncoupled from communication link 52 and/or outlet assembly 106 is uncoupled from fluid line 42 during coupling of port assembly 100 to storage container 12. In the exemplary embodiment, to couple port assembly 100 to storage container 12, the user inserts at least a portion of sensor assembly 104 and at least a portion of outlet assembly 106 through opening 50 into container 12. Cap assembly 102 is then coupled to lip 48 using coupling portion 116. As such, the user can couple sensor assembly 104, outlet assembly 106, and cap assembly 102 to storage container 12 by coupling cap assembly 102 to lip 48.

The user inputs a wash setting into control panel 30, and controller 34 controls cleaning device 10 based on the wash setting. More specifically, when the user begins a wash cycle of cleaning device 10 with the wash setting, controller 34 activates pump 40 to channel the fluid from storage container 12 into tub 36 via outlet assembly 106 and fluid line 42. In the exemplary embodiment, controller 34 is configured to automatically channel and/or supply a predetermined amount of fluid from container 12 based on the wash settings and/or user inputs. Controller 34 receives information from sensor assembly 104 to determine a property, such as a characteristic and/or measurement, of the fluid within container 12.

For example, sensor 142 detects and/or measures a level of the fluid within container 12, and controller 34 outputs a signal to control panel 30 when the fluid level is below a predetermined threshold such that a visual and/or audible indication is generated to indicate the need to re-fill container 12. Controller 34 can additionally, or alternatively, use information from sensor assembly 104 to determine a type of fluid within container 12 and/or properties or the fluid within container 12. In a particular embodiment, controller 34 determines a type of fluid within container 12 and automatically prevents an improper fluid from being discharged into tub 36. For example, controller 34 determines that bleach, rather than detergent, is within container 12 and does not channel bleach into tub 36 when detergent should be used in the wash cycle. In another example, controller 34 determines an amount of fluid to be dispensed into tub 36 from container 12 based on feedback from sensor assembly 104. For example, sensor assembly 104 detects a concentration of a fluid, such as a detergent, and controller 34 dispenses an amount of the fluid using the detected concentration.

When controller 34 and/or the user determines that fluid should be added to container 12, the user removes port assembly 100 from container 12 and pours the fluid into container 12. As such, the user removes cap assembly 102, sensor assembly 104, and outlet assembly 106 from container 12 by removing the single port assembly 100. The single port assembly 100 is re-coupled to container 12 after re-filling. Further, to clean and/or maintain container 12, the user removes single port assembly 100 from container 12 and removes container 12 from cleaning device 10. To re-install container 12, the user positions container 12 within cleaning device 10, and couples the single port assembly 100 to container 12. Accordingly, port assembly 100 enables the user to remove a single assembly from container 12 rather than removing three separate components from a single storage container, as is done with conventional storage containers.

The above-described embodiments provide a port assembly that integrates a sensor assembly and an outlet assembly with a cap assembly. The port assembly enables the user to couple the sensor assembly and the outlet assembly to a storage container within a cleaning device by coupling the cap assembly to an opening of the storage container. As such, the port assembly is easier for the user to install, as compared to the three separate components used with conventional storage containers. Further, the key enables the user to properly position the port assembly during installation to reduce improper functioning of the cleaning device. Accordingly, the embodiments described herein facilitate reducing a number of improper installations and associated service calls regarding storage containers, sensor assemblies, and/or outlet assemblies.

Exemplary embodiments of a port assembly for use with a cleaning device and method for manufacturing the same are described above in detail. The systems and method are not limited to the specific embodiments described herein, but rather, components of systems and/or steps of the method may be utilized independently and separately from other components and/or steps described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A cleaning device comprising:

a cleaning cavity configured to receive items to be cleaned;

at least two storage containers, wherein each storage container is configured to receive and store a different fluid for cleaning;

at least two port assemblies, each port assembly coupled to a respective storage container, said port assembly comprising:

a cap assembly comprising a cap having a sensor aperture and an outlet aperture and configured to couple to a lip of the respective storage container, a sensor assembly extending through said sensor aperture and coupled to the cap assembly and configured to detect at least one property of the fluid in the respective storage container, said sensor assembly comprising at least one sensor and a circuit board, and an outlet assembly coupled in fluid communication with said cleaning cavity and the respective storage container, wherein the cap is configured to seal the opening of the respective storage container to which the cap is coupled; and a controller communicatively coupled to the sensor assembly of each of the at least two port assemblies, said controller configured to at least (i) determine a fluid type of the fluid in each of the at least two storage containers based on data received from the sensor assembly to automatically prevent an undesirable fluid from being discharged into the cleaning cavity, and (ii) determine an amount of fluid to dispense based on concentration data received from the sensor assemblies and a selected wash setting;

wherein the cap defines a chamber in fluid isolation from the respective storage container, and wherein the circuit board housed within the chamber of the cap, the circuit board being communicatively coupled to the at least one sensor and the controller.

2. A cleaning device in accordance with claim 1, wherein the sensor assembly comprises at least one of a conductivity sensor, a pH level sensor, a color sensor, a viscosity sensor, a turbidity sensor, a chemical property sensor, a temperature sensor, a humidity sensor, a luminescence sensor, and a biosensor.

3. A cleaning device in accordance with claim 1, wherein the outlet assembly comprises:

an outlet tube extending to the respective storage container; and an outlet connector coupled in flow communication with said outlet tube and the cleaning cavity of the cleaning device.

4. A cleaning device in accordance with claim 3, further comprising a tube support coupled to the cap assembly, at least one of said outlet tube and said outlet connector coupled to said tube support.

5. A cleaning device in accordance with claim 4, further comprising a locking mechanism defined at the lip of the respective storage container that defines the opening of the respective storage container, wherein the cap assembly comprises a key extending from a surface thereof, the key configured to fit within the locking mechanism to facilitate proper alignment of the port assembly with respect to the respective storage container.

6. A cleaning device in accordance with claim 1, wherein the cap assembly is configured to provide venting for the respective storage container.

7. A cleaning device in accordance with claim 1, further comprising a control panel configured to receive the wash setting from a user, said controller configured to automatically dispense a fluid from any of the at least two storage containers into the cleaning cavity based on the wash setting.

8. A cleaning device in accordance with claim 7, wherein said controller is further configured to use data from the sensor assembly to determine at least one of a fluid level within the respective storage container and a property of the fluid within the respective storage container.

9. A cleaning device in accordance with claim 1, further comprising a pump coupled in flow communication with each of the outlet assemblies and the cleaning cavity.

10. A cleaning device in accordance with claim 1, further comprising a drawer positioned beneath the cleaning cavity, wherein the at least two storage containers are positioned within said drawer.

11. A cleaning device in accordance with claim 1, wherein the cap includes a bottom wall and a top wall defining opposite ends of the chamber, and a circuit board support positioned above the bottom wall, wherein the circuit board support is fixed to the bottom wall.

12. A cleaning device in accordance with claim 1, wherein the cap includes a gas filling a volume of the chamber.

* * * * *